US008952618B2

(12) United States Patent
Huang et al.

(10) Patent No.: US 8,952,618 B2
(45) Date of Patent: Feb. 10, 2015

(54) COMPENSATION METHOD AND APPARATUS FOR LIGHT EMITTING DIODE CIRCUIT

(75) Inventors: Chuan-I Huang, Hsinchu (TW); Chin-Wen Lin, Hsinchu (TW); Hsing-Yi Wu, Hsinchu (TW); Ted-Hong Shinn, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 895 days.

(21) Appl. No.: 13/157,398

(22) Filed: Jun. 10, 2011

(65) Prior Publication Data

US 2012/0223655 A1 Sep. 6, 2012

(30) Foreign Application Priority Data

Mar. 4, 2011 (TW) ..... 100107331 A

(51) Int. Cl.
*G09G 3/10* (2006.01)
*G09G 3/32* (2006.01)

(52) U.S. Cl.
CPC ..... *G09G 3/3233* (2013.01); *G09G 3/3283* (2013.01); *G09G 2300/0819* (2013.01); *G09G 2300/0857* (2013.01)
USPC ..... 315/169.3; 315/294; 315/299; 315/308; 345/214

(58) Field of Classification Search
CPC ... H05B 37/02; H05B 33/0896; G09G 3/3258
USPC ..... 345/212, 214; 315/169.3, 291, 294, 315/299, 308
See application file for complete search history.

(56) References Cited

U.S. PATENT DOCUMENTS

| | | | | |
|---|---|---|---|---|
| 6,400,101 | B1 * | 6/2002 | Biebl et al. | 315/291 |
| 7,859,501 | B2 | 12/2010 | Levey et al. | |
| 8,228,267 | B2 | 7/2012 | Leon | |
| 8,466,910 | B2 * | 6/2013 | Shirasaki et al. | 345/212 |
| 2002/0101395 | A1 | 8/2002 | Inukai | |
| 2006/0158402 | A1 | 7/2006 | Nathan et al. | |
| 2007/0290957 | A1 | 12/2007 | Cok | |

(Continued)

FOREIGN PATENT DOCUMENTS

| | | |
|---|---|---|
| CN | 101595518 A | 12/2009 |
| TW | 200738061 | 10/2007 |

(Continued)

OTHER PUBLICATIONS

"Office Action of Taiwan Counterpart Application", issued on Nov. 21, 2013, p. 1-p. 8.

(Continued)

*Primary Examiner* — Thuy Vinh Tran
(74) *Attorney, Agent, or Firm* — Jianq Chyun IP Office

(57) ABSTRACT

A compensation method for a light emitting diode (LED) circuit including a first transistor, a second transistor, a capacitor, and a LED is illustrated. A first end as a control end of the first transistor is connected to one end of the second transistor and the capacitor, and a second end of the first transistor is connected to the LED. A width to length (W/L) ratio of the second transistor is less than one. An initial control voltage is applied to a control end of the second transistor, and the current output voltage of the LED is correspondingly measured. If a difference between the current output voltage and an initial output voltage exceeds a predetermined value, a compensation voltage, which is a summation of the initial control voltage and the difference, is applied to the control end of the second transistor.

10 Claims, 4 Drawing Sheets

(56) References Cited

U.S. PATENT DOCUMENTS

| | | | | |
|---|---|---|---|---|
| 2008/0111812 | A1* | 5/2008 | Shirasaki et al. | 345/212 |
| 2009/0135114 | A1 | 5/2009 | White et al. | |

FOREIGN PATENT DOCUMENTS

| | | | |
|---|---|---|---|
| TW | 200743080 | | 11/2007 |
| TW | 200912852 | A | 3/2009 |
| TW | 201027492 | A1 | 7/2010 |

OTHER PUBLICATIONS

"First Office Action of China Counterpart Application", issued on Nov. 21, 2013, p. 1-p. 5.

* cited by examiner

COMPENSATION METHOD AND APPARATUS FOR LIGHT EMITTING DIODE CIRCUIT

BACKGROUND OF THE INVENTION

1. Field of the Invention

The present invention relates to a light emitting diode circuit; in particular, to a compensation method and a compensation apparatus for a light emitting diode circuit having the light emitting diode.

2. Description of Related Art

As development of the semiconductor industry, light emitting diodes (LEDs) are not only widely utilized for lighting to replace traditional light bulbs which has low energy efficiency but also applied to the field of display. After thin film transistor liquid crystal displays (TFT-LCDs) with backlight module virtually replace cathode ray tube (CRT) displays organic-LED (OLED)-based display devices were further introduced as they are associated with characteristics of flexibility, higher efficiency, higher image contrast, and faster response time, all of which may propel the OLED-based display devices to be one mainstream displays in the future.

Generally, an active-matrix organic-LED is driven by a driving circuit with two transistors and one capacitor (2T1C). Please refer to FIG. 1. FIG. 1 shows a circuit diagram of a traditional organic-LED circuit. The traditional organic-LED circuit 1 comprises a first transistor T1, a second transistor T2, and a capacitor CS. A first end of the first transistor T1 is coupled to a high voltage level VDD. A second end of the first transistor T1 is coupled to an input end of the organic-LED OLED. An output end of the organic-LED OLED is coupled to a grounding end. A second end of the second transistor T2 is coupled to a control end of the first transistor T1. A first end of the second transistor T2 receives a pixel signal DATA. The control end of the second transistor T2 receives a scanning signal SCAN. The capacitor CS has a first end coupled to the control end of the first transistor T1 and the second end of the second transistor T2. A second end of the capacitor CS is coupled to the grounding end.

The organic-LED OLED emits light according to an output current IOLED generated by a driving voltage VDATA of the first transistor T1. The magnitude of the light is controlled by the pixel signal DATA and the scanning signal SCAN. After the first transistor T1 has been in operation for an extended period of time, stress of the gate to source voltage Vgs (or increase in voltage level of the same) would cause a threshold voltage Vth of the first transistor T1 to drift to a higher voltage level. Therefore, the output current IOLED and the output voltage VOLED of the organic-LED would decrease, negatively affecting light-emitting efficiency of the OLED and reducing lifespan thereof.

FIGS. 2A and 2B show curves of simulated output current of the traditional organic-LED circuit with respect to the threshold voltage of the first transistor. FIG. 2A is represented in terms of a micro-ampere (μA) with the output current in FIG. 2B being normalized. As shown in FIG. 2A and FIG. 2B, if the threshold voltage Vth of the first transistor T1 increases from 0V to 3V, the output current IOLED of the organic-LED OLED may decrease from 2.05 micro-amperes to 1.3 micro-amperes.

Since the output current of the organic-LED would decrease to undermine the light-emitting efficiency of the organic-LED, the quality of lighting instruments or display devices which utilize the traditional LED circuits deteriorate or degrade as the result.

SUMMARY OF THE INVENTION

The object of the present invention is to provide a compensation method and apparatus for a light emitting diode circuit.

In order to achieve the aforementioned objects, according to an embodiment of the present invention, the compensation method is utilized for at least one light emitting diode which includes a first transistor, a second transistor, a capacitor, and a light emitting diode. A control end of the first transistor is connected to the capacitor and a second end of the second transistor. A second end of the first transistor is connected to the light emitting diode, and a width to length ratio (W/L) of the second transistor is less than one. The compensation method includes applying an initial control voltage to a control end of the second transistor, and detecting a current value of an output voltage of the light emitting diode, determining whether a difference of a current value and an initial value of the output voltage exceeds a predetermined value, and generating a compensation voltage and applying the compensation voltage to the control end of the second transistor if the difference exceeds the predetermined value. The compensation voltage is summation of the initial control voltage and the difference.

In order to achieve the aforementioned objects, according to an embodiment of the present invention, a compensation apparatus for light emitting diode circuit is utilized for at least one light emitting diode having a first transistor, a second transistor, a capacitor, and a light emitting diode. A control end of the first transistor is connected to the capacitor and a second end of the second transistor. A second end of the first transistor is connected to the light emitting diode, and the width to length (W/L) ratio of the second transistor is less than one. The compensation apparatus may further include a plurality of memory units, a logic and comparison unit, and a processing circuit unit. The memory units are used for memorizing an initial value and a current value of the output voltage of the light emitting diode. The compensation apparatus is configured to apply an initial control voltage to a control end of the second transistor, such that the light emitting diode generates the current value of the output voltage accordingly. The logic and comparison unit is used to determine whether a difference of the current value and the initial value of the output voltage exceeds a predetermined value. The processing circuit unit generates a compensation voltage and applies the compensation voltage to the control end of the second transistor according to the difference and the initial control voltage if the difference exceeds the predetermined value.

In summary, the method and apparatus for light emitting diode circuit detect the output voltage of the light emitting diode, and stabilizes the output current of the light emitting diode by maintaining the output voltage of the light emitting diode. Therefore, potential decrease in the output current of the light emitting diode as the result of operating for the extended period of time may be avoided, extending the lifespan of the light emitting diode.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

[An Embodiment of the Compensation Method for Light Emitting Diode Circuit]

Figure 1:
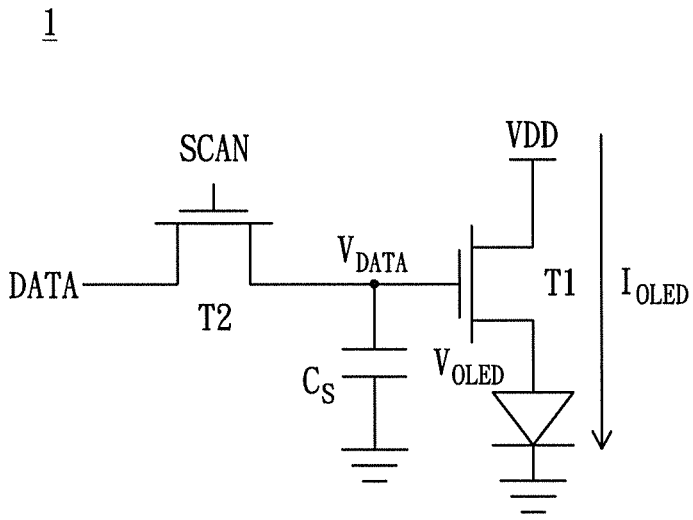
FIG. 1(PRIOR ART)
FIG. 1 shows a circuit diagram of a traditional organic-LED circuit.
Figure 2A:
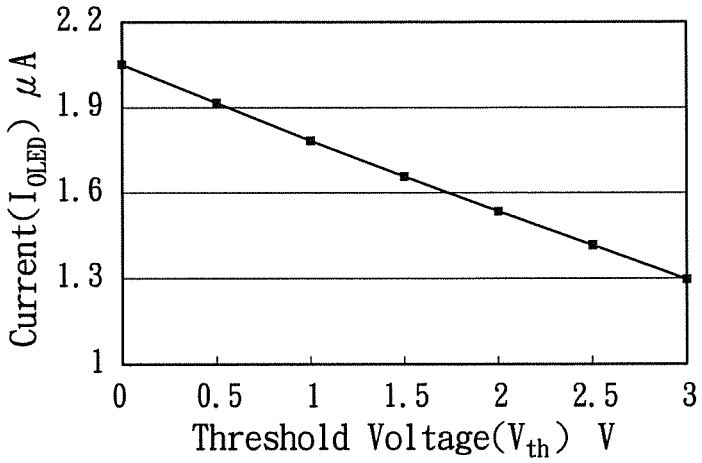
FIG. 2A(PRIOR ART)
FIGS. 2A and 2B show curves simulated output current of the traditional organic-LED circuit with respect to the threshold voltage of the first transistor.
Figure 2B:
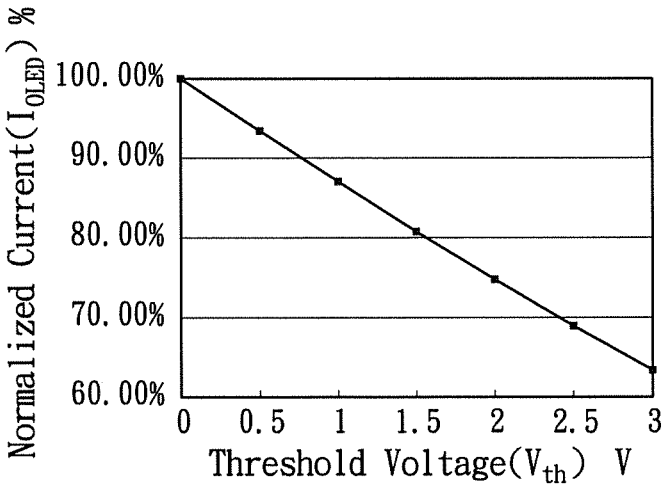
FIG. 2B(PRIOR ART)
Figure 3:
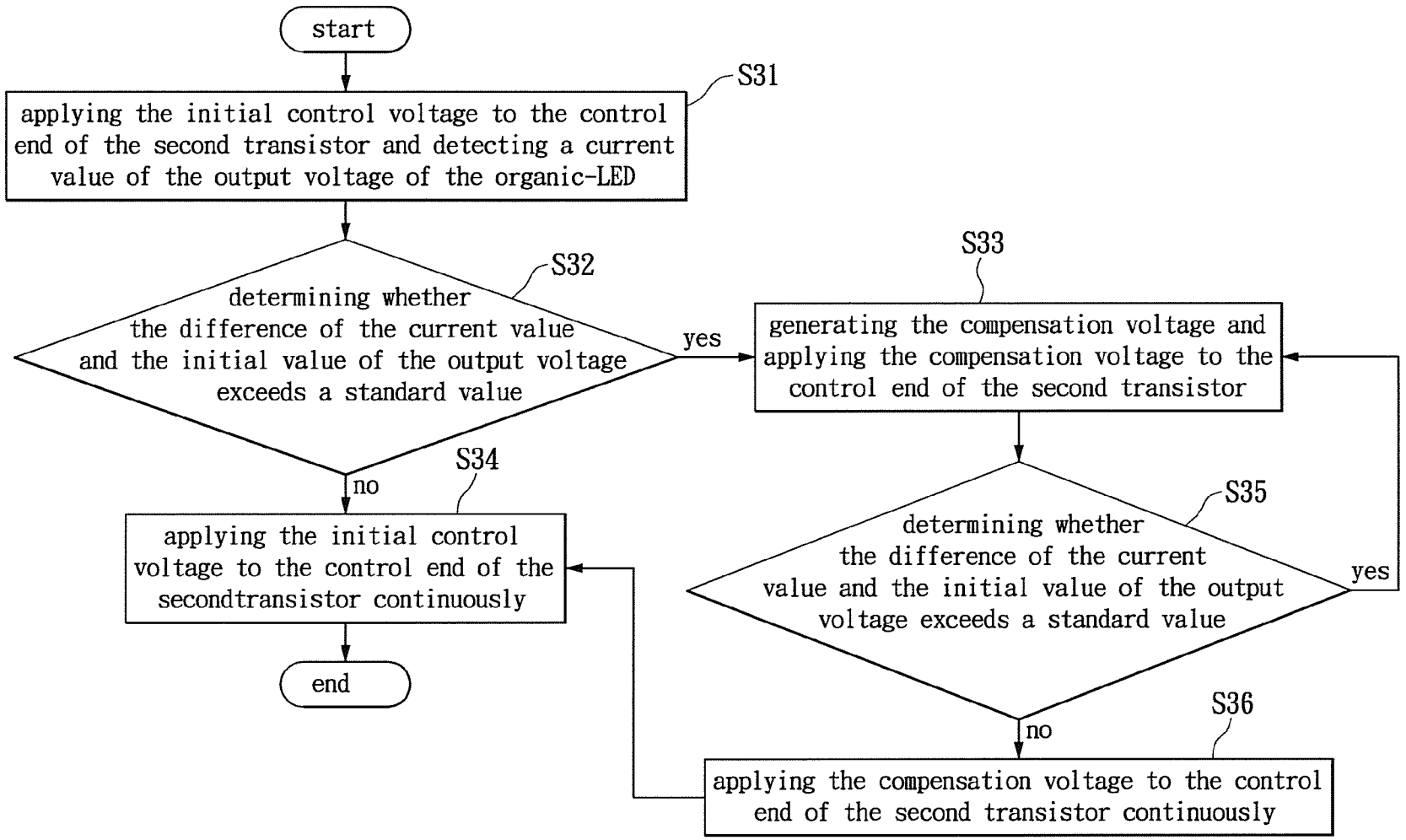
FIG. 3 shows a flow diagram of a compensation method for light emitting diode circuit according to an embodiment of the present invention.

Please refer to FIG. 1 and FIG. 3. FIG. 3 shows a flow diagram of a compensation method for a light emitting diode circuit according to an embodiment of the present invention. The compensation method for light emitting diode circuit is utilized for compensating an organic-LED circuit 1 having transistors T1 and T2, a capacitor CS, and an organic-LED OLED. A first end serving as a control end of the first transistor T1 is connected to the capacitor CS and a second end of the second transistor T2. In one implementation, the control end is a gate end of the first transistor T1 while the second end of the second transistor T2 is a source end thereof. A second end of the first transistor T1, which may be a source end of the first transistor T1, is connected to an input end of the organic-LED OLED. A width to length (W/L) ratio of the second transistor T2 in one implementation may be less than one. It is worth noting that the compensation method for light emitting diode circuit disclosed in the present invention may be applied to other light emitting diode circuits that are 2T1C (two transistors and one capacitor) in their structure.

The compensation method illustrated in FIG. 3 may increase a voltage of a first end, which serves as a control end, of the second transistor T2 to stabilize an output voltage VOLED of the organic-LED OLED. In one implementation, the control end of the second transistor T2 is the gate end of the second transistor T2. The voltage applied to the control end of the second transistor T2 needs not to be a high voltage (for example, 5 Volts), such that the voltage of the control end of the first transistor T1 may not be fully charged to a voltage VDATA of a pixel signal (DATA) during a charging period.

When the voltage of the control end of the second transistor T2 increases, the voltage of the control end of the first transistor T1 increases accordingly. The voltage of the control end of the first transistor T1 may thus approach to the voltage VDATA of the pixel signal (DATA) during the charging period so as to compensate the decrease in the output voltage VOLED due to the drift of a threshold voltage Vth of the first transistor T1. As such, an output current IOLED may be stabilized It is worth noting that the compensation method illustrated in FIG. 3 may be performed periodically (for example, per 1000 hours). In other words, the decrease in the output current IOLED as the result of the increase in the voltage at the gate end of the first transistor T1 may be compensated for every predetermined period.

Please refer to FIG. 1 and FIG. 3 again. First, in accordance with step S31, the compensation method of the present invention includes applying an initial control voltage Vgate_ini to the control end of the second transistor T2 (in other words, setting a scanning SCAN as the initial control voltage), and detecting a current value VOLED_now of the output voltage VOLED of the organic-LED OLED. In step S32, the compensation method further includes determining whether a difference of the current value VOLED_now of the output voltage VOLED and an initial value VOLED_ini of the output voltage VOLED exceeds a predetermined standard value. In one implementation, the predetermined value is zero. When the difference does not exceed the predetermined value, the compensation method goes to step S34; otherwise, the compensation method performs step S33.

It is worth mentioning that the initial control voltage Vgate_ini is an initial driving voltage of the organic-LED circuit 1. The initial value VOLED_ini of the output voltage VOLED is an initial output voltage of the organic-LED circuit 1 at the time the initial control voltage Vgate_ini is applied to drive the organic-LED circuit 1. As the initial values of the initial driving voltage and the output voltage of the organic-LED circuit 1 may be necessary for the determination of whether the differences between them and their counterparts after the organic-LED circuit 1 has been in operation, the compensation method in FIG. 3 may further include memorizing the initial control voltage Vgate_ini and the initial value VOLED_ini of the output voltage VOLED in a plurality of memory units. In one implementation, the memory unit may be a register.

In accordance with step S34, if the difference does not exceed the predetermined value, which is indicative of the output current IOLED does not decrease due to continuing operations, the compensation method therefore apples the initial control voltage Vgate_ini to the control end of the second transistor T2 continuously. In accordance with step S33, if the difference, however, exceeds the predetermined value, which indicates that the output current IOLED has decreased due to the long-term operations, the compensation method further includes generating a compensation voltage Vgate and applying the compensation voltage Vgate to the control end of the second transistor T2. In other words, the compensation method of the present invention sets the applied compensation voltage Vgate as the scanning signal SCAN in FIG. 1). In one implementation, the compensation voltage Vgate is a summation of the initial control voltage Vgate_ini and the difference, which is equal to Vgate_ini+VOLED_ini−VOLED_now.

In step S32, the compensation method of the present invention may utilize a comparator to determine whether the difference of the current value VOLED_now and the initial value VOLED_ini of the output voltage VOLED exceeds the predetermined value. In step S33, the compensation method may employ an invert amplifier to calculate the difference of the initial value VOLED_ini and the current value VOLED_now of the output voltage VOLED according to the initial value VOLED_ini and the current value VOLED_now of the output voltage VOLED (VOLED_ini−VOLED_now). With the invert amplifier, an inverted difference (−VOLED_ini+VOLED_now) may be prepared. Thereafter, the compensation method further relies on the invert amplifier to calculate the compensation voltage Vgate according to the difference and the initial control voltage Vgate_ini.

In step S35, the compensation method further includes re-determining whether the difference of the current value VOLED_now of the output voltage VOLED and the initial value VOLED_ini of the output voltage VOLED exceeds the predetermined value. In step S35, the current value VOLED_now of the output voltage VOLED is generated by the light emitting diode circuit 1 according to the compensation voltage Vgate. Then, if the difference does not exceed the predetermined value, step S36 may be performed. Otherwise, the compensation method of the present invention returns to step S33. In step S36, the compensation method applies the compensation voltage Vgate to the control end of the second transistor T2 continuously. In doing so, the compensation method of the present invention may ensure the difference of the initial value VOLED_ini and the current value VOLED_now of the output voltage VOLED does not exceed the predetermined value by repeating steps S33~S36.

In practical applications, light emitting diode may be utilized in color displays, and each pixel of the color display may correspond to the light emitting diodes of a red pixel, a green pixel, and a blue pixel. The compensation method according to the embodiment of the present invention may compensate the light emitting diodes of the red pixel, the green pixel, and the blue pixel, or direct to the light emitting diode of a pixel that has been degraded the most.

[An Embodiment of the Compensation Apparatus for Light Emitting Diode Circuit]

Figure 4:
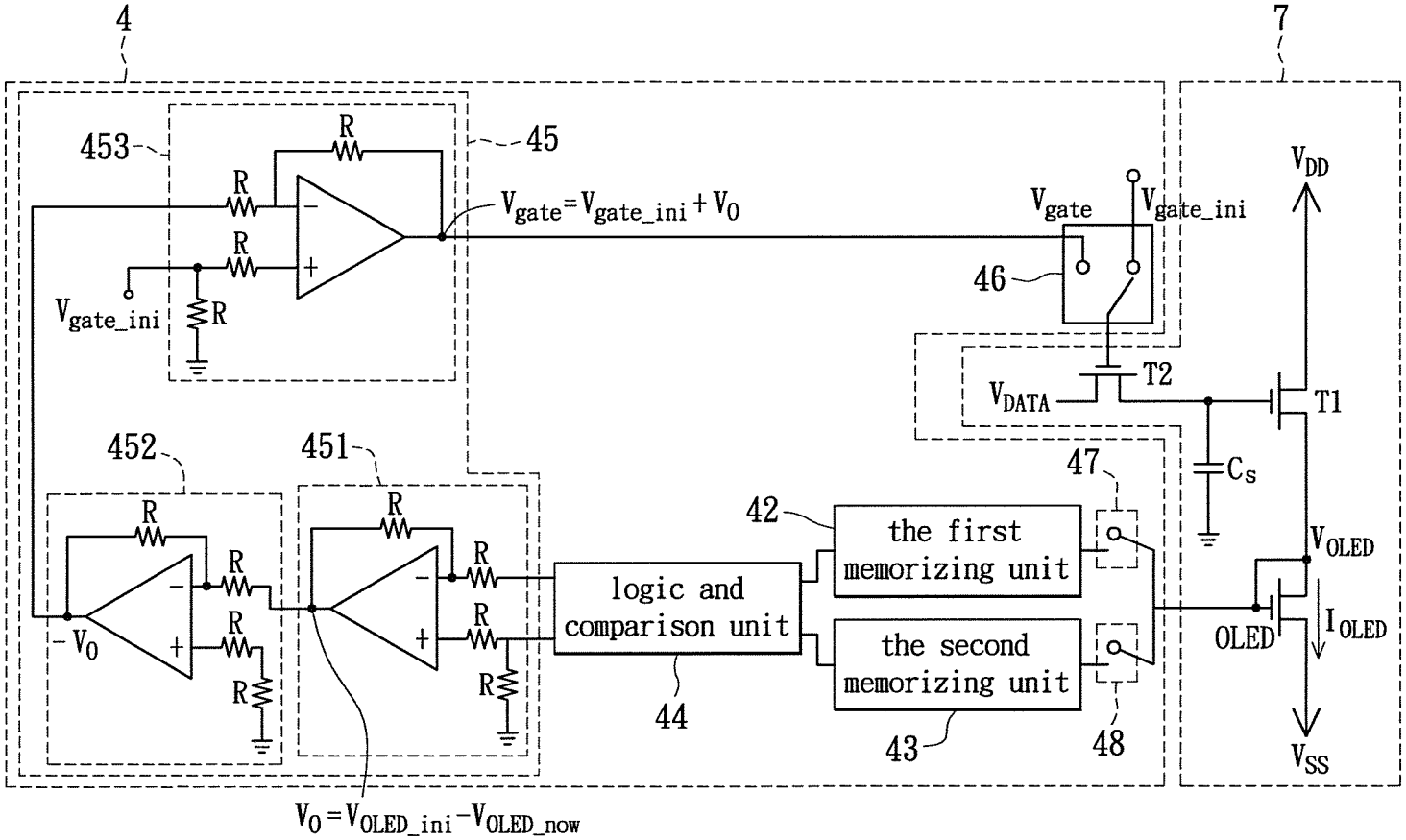
FIG. 4 shows a circuit diagram of a compensation apparatus for light emitting diode circuit according to an embodiment of the present invention.

Please refer to FIG. 4. FIG. 4 shows a circuit diagram of a compensation apparatus 4 for a light emitting diode circuit according to an embodiment of the present invention. The compensation apparatus 4 is utilized for a light emitting diode circuit. In one implementation, the light emitting diode circuit is an organic light emitting diode circuit 7. The light emitting diode circuit 7 may include a first transistor T1, a second transistor T2, a capacitor CS, and an organic-LED OLED. Both the first transistor T1 and the second transistor T2 may include first ends and second ends, respectively. The first end as a control end of the first transistor T1 is connected to the capacitor CS and the second end of the second transistor T2. The second end of the first transistor T1 is connected to an input end of the organic-LED OLED. The first end of the first transistor T1 is coupled to a voltage level VDD. An output end of the organic-LED OLED is coupled to another voltage level VSS. It is worth noting that the voltage level VDD may be higher than the voltage level VSS. The first end of the second transistor T2 is coupled to the pixel signal VDATA. The control end (or the first end) of the second transistor T2 is coupled to an initial control voltage Vgate_ini or a compensation voltage Vgate. The width-to-length ratio (W/L) of the second transistor T2 may be less than one. It is worth mentioning that the organic-LED OLED is a transistor having a first end and a control end, which may be a gate end of the transistor, coupled to each other.

The compensation apparatus 4 for light emitting diode circuit may further include a first memory unit 42, a second memory unit 43, a logic and comparison unit 44, a processing circuit unit 45, a switching device 46, and switches 47 and 48. The processing circuit unit 45 may further include a first differential amplifier 451, a second differential amplifier 452, and a third differential amplifier 453.

The first memory unit 42 and the second memory unit 43 are coupled to the input end of the organic-LED OLED through switches 47 and 48, respectively. The logic and comparison unit 44 is coupled to the first memory unit 42 and the second memory unit 43. An input end of the processing circuit unit 45 is coupled to the logic and comparison unit 44. An output end of the processing circuit unit 45 is coupled to the control end of the second transistor T2. Besides, another memorizing unit (not shown in FIG. 4) may be coupled to the output end of the processing circuit 45 for memorizing the compensation voltage Vgate.

The first memory unit 42 and the second memory unit 43 may be configured to memorize the current value VOLED_now and the initial value VOLED_ini of the output voltage VOLED of the organic-LED OLED, respectively. In one implementation, the switch 47 may only be turned on when the organic light emitting diode circuit 7 is just driven. On the other hand, the switch 48 may be turned on for a predetermined period of time.

When the light emitting diode is just driven, the switching device 46 may switch to the initial control voltage Vgate_ini with the switch 47 turned on, thus the first memory unit 42 memory the initial value VOLED_ini of the output voltage VOLED generated by the organic light emitting diode circuit 7 according to the initial control voltage Vgate_ini. The compensation apparatus 4, thereafter, may apply the initial control voltage Vgate_ini to the control end of the second transistor T2 through the switching device 46, so that the organic-LED OLED may generate the current value VOLED_now of the output voltage VOLED, which may be stored in the second memory unit 43.

Meanwhile, the logic and comparison unit 44 compares the initial value VOLED_ini and the current value VOLED_now of the output voltage VOLED of the organic-LED OLED, before the difference VO may be obtained and whether the difference VO exceeds the predetermined value may be determined. By determining the difference VO on basis of the different output voltages VOLED (i.e., the different current values VOLED_now), the logic and comparison unit 44 may cause the processing circuit unit 45 to generate the compensation voltage Vgate. More specifically, when the organic light emitting diode circuit 7 operates for a predetermined period of time, the logic and comparison unit 44 of the compensation apparatus 4 may be enabled for determining whether the difference VO exceeds the predetermined value before the processing circuit 45 may be further enabled.

If the difference VO does not exceed the predetermined value, which may indicate that there is no need to change the voltage applied to the control end of the second transistor T2 as the compensation apparatus 4 may control operation of the switching device 46 so as to continuously output the initial control voltage Vgate_ini to the control end of the second transistor T2. If the difference VO exceeds the predetermined value, the compensation apparatus 4 may cause the compensation voltage Vgate to be applied to the control end of the second transistor T2.

In one implementation, gains of the first differential amplifier 451, the second differential amplifier 452, and the third differential amplifier 453 are configured to be one. When the difference VO exceeds the predetermined value, the logic and comparison unit 44 may output the initial value VOLED_ini of the output voltage VOLED of the organic-LED OLED to a positive input end of the first differential amplifier 451 of the processing circuit unit 45. And, the logic and comparison unit 44 may output the current value VOLED_now of the output voltage VOLED of the organic-LED OLED to a negative input end of the first differential amplifier 451 of the processing circuit unit 45, leading to the first differential amplifier 451 to output the difference VO of the initial value VOLED_ini and the current value VOLED_now of the output voltage VOLED.

A positive input end of the second differential amplifier 452 may be grounded. A negative input end of the second difference is coupled to the difference VO, such that the second differential amplifier 452 outputs a negative difference VO. Meanwhile, a positive input end of the third differential amplifier is coupled to the initial control voltage Vgate_ini, and a negative input end of the third differential amplifier 453 is coupled to the negative difference VO. Under this arrangement, the third differential amplifier 453 may output the compensation voltage Vgate, which is equal to Vgate_ini+VO.

Further more, in practical applications, light emitting diodes can be utilized to the color displays with light emitting diodes of three primary colors. Accordingly, the compensation apparatus 4 may be configured to compensate the light emitting diodes of the three primary colors, or compensate the light emitting diode that has been degraded the most.

Besides, the compensation apparatus 4 may be fabricated on a printed circuit board and assemble (Printed Circuit Board and Assemble, PCBA) for simplifying fabrication process.

In summary, the mentioned compensation apparatus for light emitting diode circuit can detect or detect periodically output voltage of light emitting diodes. The compensation apparatus for light emitting diode circuit maintains output voltage of light emitting diodes for stabilizing operation current of light emitting diodes. Accordingly, deterioration of operation current of the light emitting diode due to long-term operation can be avoided.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A compensation method for a light emitting diode circuit having a first transistor and a second transistor, a capacitor, and a light emitting diode, the compensation method comprising:

applying an initial control voltage to a control end of the second transistor, and detecting a current value of an output voltage of the light emitting diode;

determining whether a difference of the current value of the output voltage of the light emitting diode and an initial value of the output voltage of the light emitting diode exceeds a predetermined value; and generating a compensation voltage and applying the compensation voltage to the control end of the second transistor when the difference exceeds the predetermined value, wherein the compensation voltage is summation of the initial control voltage and the difference.

2. The method according to claim 1 further comprising:

applying the initial control voltage to the control end of the second transistor continuously if the difference does not exceed the predetermined value.

3. The method according to claim 2 further comprising:

re-determining whether a difference of the current value of the output voltage of the light emitting diode and the initial value of the output voltage of the light emitting diode exceeds the predetermined value, wherein the current value of the output voltage is generated by the light emitting diode circuit according to the compensation voltage;

applying the compensation voltage continuously when the difference does not exceed a standard value; and re-generating the compensation voltage when the difference of the current value of the output voltage and the initial value of the output voltage exceeds the predetermined value.

4. The method according to claim 1, wherein the method compensates light emitting diode circuits of a red pixel, a green pixel, and a blue pixel, or compensates the light emitting diode circuit of a pixel that has been degraded the most.

5. An compensation apparatus for a light emitting diode circuit having a first transistor with a first end as a control end thereof and a second end, and a second transistor having a first end as a control end thereof and a second end, a capacitor, and a light emitting diode, wherein the control end of the first transistors is connected to the capacitor and the second end of the second transistor, the second end of the first transistor is connected to the light emitting diode, and a width to length ratio is less than one, the compensation apparatus comprising:

a plurality of memory units, for memorizing an initial value of an output voltage of the light emitting diode and a current value of the output voltage of the light emitting diode, wherein the apparatus applies an initial control voltage to the control end of the second transistor, such that the light emitting diode generates the current value of the output voltage;

a logic and comparison unit, for determining whether a difference of the current value and the initial value of the output voltage exceeds a predetermined value; and a processing circuit unit, generating a compensation voltage and applying the compensation voltage to the control end of the second transistor according to the difference and the initial control voltage when the difference exceeds the predetermined value.

6. The compensation apparatus for light emitting diode circuit according to claim 5, wherein the compensation voltage is summation of the initial control voltage and the difference.

7. The compensation apparatus for light emitting diode circuit according to claim 5, wherein the compensation apparatus applies the initial control voltage to the control end of the second transistor continuously when the difference does not exceed the predetermined value.

8. The compensation apparatus for light emitting diode circuit according to claim 5 further comprises another memory unit for memorizing the compensation voltage, the logic and comparison unit re-determines whether the difference of the initial value of the output voltage and the current value of the output voltage exceeds the predetermined value, wherein the current value of the output voltage is generated by the light emitting diode according to the compensation voltage, the compensation apparatus continuously applies the compensation voltage if the difference does not exceed a standard value, and the compensation apparatus re-generates the compensation voltage when the difference exceeds the predetermined value.

9. The compensation apparatus for light emitting diode circuit according to claim 5, wherein the compensation apparatus compensates light emitting diode circuits of a red pixel, a green pixel, and a blue pixel, or compensates the light emitting diode circuit of a pixel that has been degraded the most.

10. The compensation apparatus for light emitting diode circuit according to claim 5, wherein the compensation apparatus and the light emitting diode are fabricated on a printed circuit board and assemble (PCBA).

* * * * *